United States Patent [19]
Lake
[11] 4,210,485
[45] Jul. 1, 1980

[54] WALLPAPER APPLICATOR

[76] Inventor: Ernest C. Lake, Lot 16, Glenrock Pde., Koolewong, New South Wales, Australia, 2256

[21] Appl. No.: 929,310

[22] Filed: Jul. 31, 1978

[30] Foreign Application Priority Data

Aug. 8, 1977 [AU] Australia ..... PD1133

[51] Int. Cl.² ..... B44C 7/00
[52] U.S. Cl. ..... 156/577; 156/575
[58] Field of Search ..... 156/575, 577, 574

[56] References Cited

U.S. PATENT DOCUMENTS 1,343,106 6/1920 Banse ..... 156/575
2,191,238 2/1940 Rasanen ..... 156/577
2,658,639 11/1953 Goldberg ..... 156/575
3,900,362 8/1975 Schaffer ..... 156/577

*Primary Examiner*—Douglas J. Drummond
*Attorney, Agent, or Firm*—Charles B. Haverstock

[57] ABSTRACT

The invention relates to a wallpaper applicator by means of which wallpaper can be fed on to a wall and adhered thereto with the assistance of one or more rollers rotatably mounted on the applicator. The applicator can be adapted to single-handed operation and can incorporate a water tank so that ready-pasted wallpaper can be soaked in the applicator immediately before being applied to a wall.

1 Claim, 5 Drawing Figures

WALLPAPER APPLICATOR

This invention is concerned with a device for applying wallpaper and the like to a surface.

Previously, the affixing of wallpaper to a surface such as a wall or a ceiling has been a relatively awkward and difficult process.

Firstly, it has been necessary to measure the length of the surface to be papered and sever from a roll of wallpaper a strip having approximately that same length. Sometimes a miscalculation is made, and the length severed is too short and must be discarded; alternately a "patch" of extra wallpaper can be used to supplement the length of the original piece, although this tends to detract from the appearance of the papered surface. On the other hand, very frequently the length severed is substantially longer than required, with the result that the excess must be discarded as waste.

It is an object of this invention, in one embodiment thereof, to eliminate the need to sever lengths from a roll of wallpaper before the paper has been applied to a surface. In this embodiment, the wallpaper is severed only after application of the paper to a surface. It will be appreciated that this embodiment minimizes wastage of wallpaper and avoids errors in severing lengths.

Before the advent of the device of this invention, after each length of wallpaper had been severed from the roll and pasted on the reverse side thereof, or soaked in water in the case of "ready-pasted" type wallpaper, the length had to be positioned on the surface and a small sponge or similar device was used to press the paper to the surface. Using this method, pressure could be applied only to a small area of the length of wallpaper at a time. Because wallpaper is generally supplied in tightly-wound rolls, each end of a severed length has a tendency to curl away from the surface before it is adequately adhered by pressure. Thus, while a sponge was used to apply pressure to one end of the length of wallpaper, the other end tended to curl up and deposit paste on any nearby object.

It is a further object of this invention to provide a device which enables a length of wallpaper to be applied to a surface while avoiding this "curling end" problem.

Another drawback with prior art processes is encountered when the wallpaper is fairly fragile. When this type of wallpaper is applied to a wall, for example, it is common practice to adhere the strip of wallpaper to the highest part of the wall first, permitting the remainder of the strip to hang loosely against the wall meanwhile. The hanging portion of the strip is heavy with water and/or paste and frequently tears under the influence of gravity.

It is a further object of this invention to provide an applicator device which incorporates means for supporting a length or roll of wallpaper to prevent tearing as described.

Further, it is found that positioning of pasted wallpaper on a surface invariably traps pockets of air between the surface and the wallpaper, and it is essential that these air bubbles are eliminated if the papered surface is to have an acceptable appearance. It is possible to remove most air bubbles with a damp sponge before the paste sets but this procedure is time-consuming and not entirely successful.

It is therefore yet a further object of this invention to provide a device capable of adhering wallpaper to a surface in an even manner and thus avoid the trapping of air bubbles between the paper and the surface.

Accordingly, this invention provides a device for applying wallpaper and the like to a surface, said device comprising a support for the wallpaper and a roller mounted for rotation on the device, such that the roller is adapted to press successive areas of the wallpaper against successive areas of the surface as the wallpaper is fed from the support onto said surface.

The expression "wallpaper and the like" used herein refers to any flexible sheet material treated on one side for application to a surface. The expression may thus encompass materials which are not conventional wallpapers but which are suitable for use with the device of the invention.

It is preferred that there is incorporated a handle to facilitate manipulation of the device of this invention.

In an especially-preferred embodiment of this invention, a pair of rollers are mounted for rotation on the device, the longitudinal axes of the rollers being parallel. In this embodiment one roller contacts the unpapered surface while the other roller exerts pressure on wallpaper fed from the support, as described above.

The roller or rollers may be constructed of any suitable material such as wood, plastic or metal, provided such material can remain sufficiently rigid to exert the necessary pressure. Each roller is preferably two inches in diameter, although when two rollers are used both rollers need not be the same size. It has been found that papering of walls around door architraves is facilitated when each roller has a diameter of approximately two inches.

The length of each roller may vary but is preferably the length of an average wallpaper width, namely twenty-one inches. It will be appreciated that the device of the invention can be most efficiently employed when the roller intended to exert pressure on the wallpaper against the surface has a length approximately the same as the wallpaper width.

So that a single device according to this invention can accommodate a plurality of wallpaper widths, it is within the scope of this invention that the or each roller is replaceable by a roller of greater or less length, or larger or smaller diameter, as desired.

In particular, it has been found advantageous to replace the roller adapted to exert pressure on the wallpaper with a roller of short length to enable the device to be used in applying wallpaper to narrow areas, for example to a strip of wall between a door or window and an adjacent wall.

The support for the wallpaper in the device of this invention may take various forms. In its simplest form, the support is simply a bar or a roller adapted to take the weight of a length or roll of wallpaper. In this embodiment a brake or similar part is preferably included in the device so that the wallpaper is prevented from slipping over the bar or roller in the wrong direction during manipulation of the device.

In another embodiment, the support forms a receptacle for a roll or length of wallpaper; the receptacle may, for example, take the form of an elongated box having a slit through which the wallpaper is fed to the roller.

In yet another embodiment, the support permits a whole roll of wallpaper to be mounted thereon and is optionally associated with a water tank through which wallpaper from the support is passed before being fed onto the surface to be papered.

The invention will now be described with reference to some preferred embodiments thereof illustrated in the accompanying drawings, which are not, however, intended to be limiting on the scope of the invention.

Figure 1:
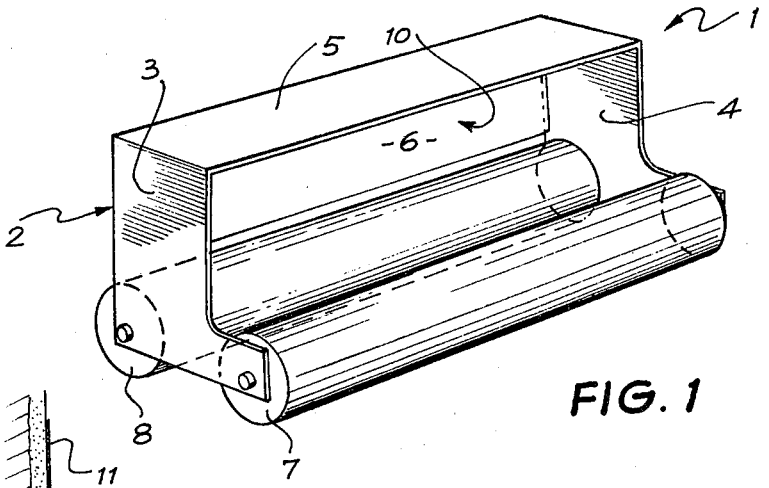
FIG. 1 is a perspective view of one embodiment of the device of the invention.

Referring first to FIG. 1, the device is generally indicated at 1 and comprises a receptacle 2 having side walls 3 and 4 and a rear wall 5. Support 6 in receptacle 2 is intended to support a roll of wallpaper. A pair of spaced wooden rollers 7 and 8, each of 2 inches diameter, are rotatably mounted in side walls 3 and 4.

Figure 2:
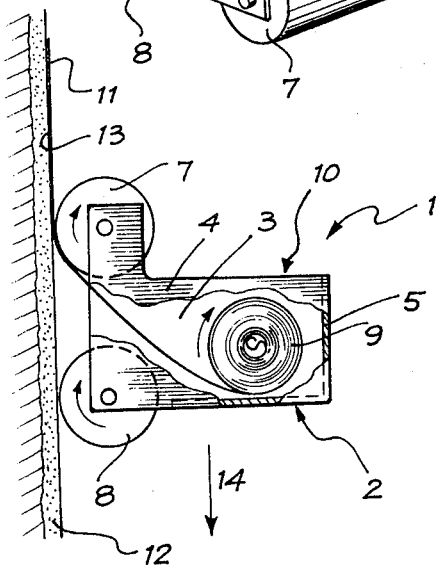
FIG. 2 illustrates the application of wallpaper to a surface using the device of FIG. 1.

In FIG. 2, side wall 4 has been partly broken away to reveal a roll of wallpaper 9 in receptacle 2. The roll 9 has been pasted, or soaked in water in the case of ready-pasted paper, before being inserted in receptacle 2 through opening 10 provided for that purpose. The leading edge 11 of roll 9 is passed under roller 7 between that roller and wall surface 12. Pressure on roller 7 helps to adhere paper from roll 9 to surface 12 as shown at 13. As device 1 travels down surface 12 in the direction of arrow 14, paper from roll 9 is continuously pressed by rotating roller 7 onto the surface 12. Roller 8 helps to steady the device 1 and rotates to permit smooth passage of the device 1 down surface 12.

Rear wall 5 is dimensioned to fit comfortably into an average-sized hand and thus forms a handle for the device, so that the device can be manipulated by one hand leaving the other free.

Because roller 7 continuously presses paper from roll 9 against surface 12, air bubbles do not form between the wallpaper and surface 12. In addition, the wallpaper in roll 9 is continuously supported in receptacle 2 and consequently fragile wallpaper does not tear under the influence of gravity as described hereinabove.

Figure 3:
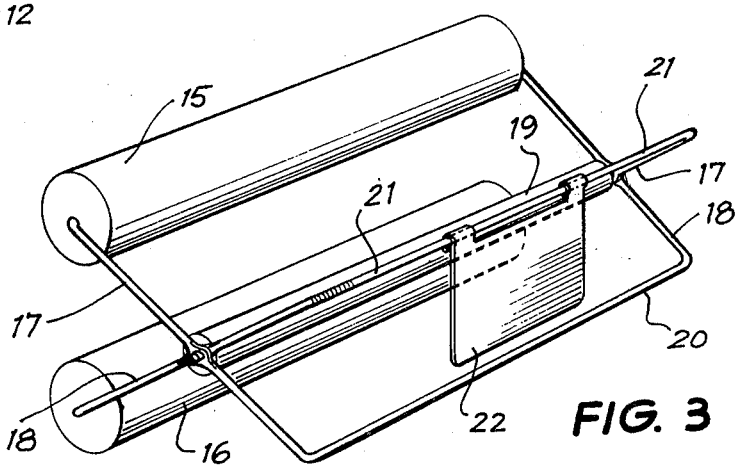
FIG. 3 is a perspective view of a second embodiment of the device of the invention.
Figure 4:
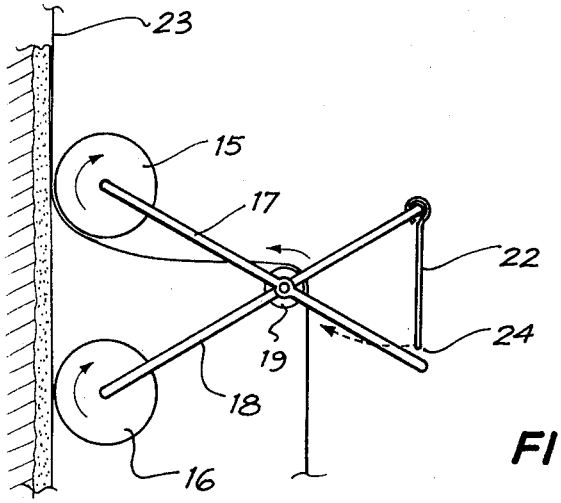
FIG. 4 illustrates the application of wallpaper to a surface using the device of FIG. 3.

The device illustrated in FIGS. 3 and 4 comprises a pair of spaced plastic rollers 15 and 16 each rotatably mounted on the open ends of "U" shaped bars 17 and 18 respectively. Roller 19 extends between the points of intersection of bars 17 and 18 and is rotatably mounted therebetween. Parts 20 and 21 of bars 17 and 18 provide a convenient handle for the device. Brake 22 is also rotatably mounted on part 21 of bar 18.

The device is preferably used in association with a whole roll of "ready-pasted" wallpaper which is soaking in a conventional trough (not shown). The leading edge 23 of the wallpaper roll (See FIG. 4) is fed over roller 19 and between rollers 15 and 16. Brake 22 is then applied by rotating the brake so that edge 24 bears against the wallpaper around roller 19, thus preventing the wallpaper from falling back into the trough. Leading edge 23 is pressed against a wall surface and the wallpaper is applied to the surface in the same manner as the previous embodiment, brake 22 being released as required.

When the desired length of wallpaper has been applied to the surface, that length is severed from the main roll of wallpaper, and the process can be repeated.

Figure 5:
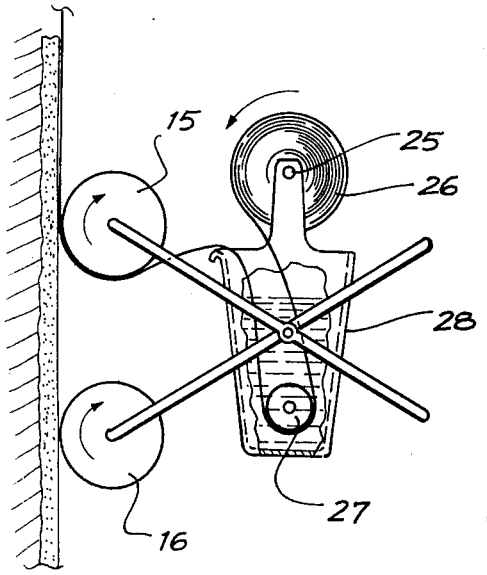
FIG. 5 is a side view of a third embodiment of the device of the invention.

Referring now to FIG. 5, the device is similar to that illustrated in FIGS. 3 and 4, except that roller 19 is replaced by water tank 28 on which is mounted bar 25, which can carry a full roll of pre-pasted wallpaper 26. In this embodiment, wallpaper from roll 26 is fed into tank 28, around roller 27 and through rollers 15 and 16. Thus the wallpaper is soaked and applied to a surface in a continuous action.

The device illustrated in FIG. 5 is especially intended for use by professional wallpaper hangers and it is anticipated that using the device illustrated, a job which would previously take six to eight hours can be reduced to four hours or less.

I claim:

1. A device for applying wallpaper and the like to a surface comprising first and second rollers each rotatably mounted on the open ends of U-shaped bars, said bars being held in fixed relationship with each other to form an X on each side and having a third roller mounted between the points of axis of said U-shaped bars, and a brake pivotally mounted on the outer closed portion of one of said U-shaped bars, said wallpaper being fed from the support over said third roller and under said first roller which is adapted to press successive areas of the wallpaper against successive areas of the surface as the wallpaper is fed from the support onto the surface, said second roller acting as an idler and adapted to contact one area of the unpapered surface at the same time that said first roller is pressing the wallpaper against another area of the surface, said brake being movable to frictionally engage the wallpaper as it passes over said third roller.

* * * * *